United States Patent [19]

Schleupen

[11] Patent Number: 4,848,298

[45] Date of Patent: Jul. 18, 1989

[54] DEVICE FOR CONTROLLING INTERNAL COMBUSTION ENGINE

[75] Inventor: Richard Schleupen, Ingersheim, Fed. Rep. of Germany

[73] Assignee: Robert Bosch GmbH, Stuttgart, Fed. Rep. of Germany

[21] Appl. No.: 214,737

[22] PCT Filed: Aug. 8, 1987

[86] PCT No.: PCT/DE87/00347

§ 371 Date: Mar. 28, 1988

§ 102(e) Date: Mar. 28, 1988

[87] PCT Pub. No.: WO88/01691

PCT Pub. Date: Mar. 10, 1988

[30] Foreign Application Priority Data

Sep. 5, 1986 [DE] Fed. Rep. of Germany ..... 3630272

[51] Int. Cl.[4] ..... F02P 7/067

[52] U.S. Cl. ..... 123/414; 123/617; 123/643

[58] Field of Search ..... 123/414, 599, 602, 617, 123/643

[56] References Cited

U.S. PATENT DOCUMENTS 3,465,739 9/1969 Burson ..... 123/599 X 4,327,687 5/1982 Haubner et al. ..... 123/414 X 4,617,906 10/1986 Hill ..... 123/617

FOREIGN PATENT DOCUMENTS 71885 2/1983 European Pat. Off. .

1209361 1/1966 Fed. Rep. of Germany .

2726132 12/1978 Fed. Rep. of Germany .

*Primary Examiner*—Tony M. Argenbright

*Attorney, Agent, or Firm*—Michael J. Striker

[57] ABSTRACT

A device for controlling an internal combustion engine of a motor vehicle comprises a stationary pickup element provided with a control circuit for ignition or the like of a motor vehicle, and a transducer wheel arranged to rotate with the shaft of the engine of the motor vehicle and operatively connected with the stationary pickup element, the transducer wheel having a circumference and being provided on the circumference with a number of segments that is proportional to a number of cylinders of the engine, the segments affecting the pickup element and extending substantially in a circumferential direction, at least one of the segments having a perforation with a width which is measured in a direction transverse to a direction of elongation of the segment and which increases in the direction of elongation of the segment to supply a signal serving as a marking for the control circuit.

10 Claims, 2 Drawing Sheets

FIG. 4
FIG. 4a
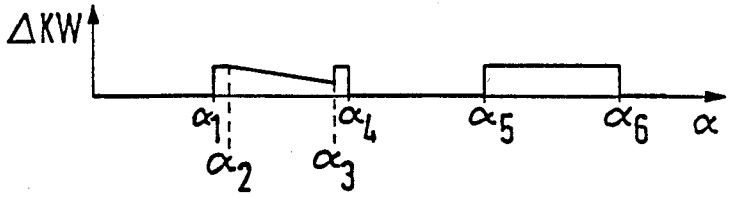
FIG. 4b
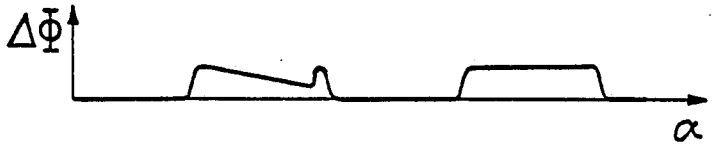
FIG. 4c
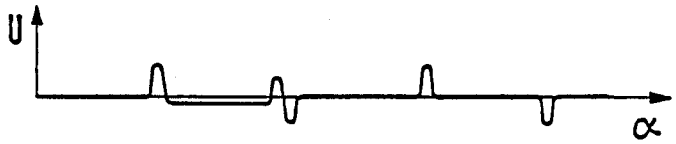
FIG. 5
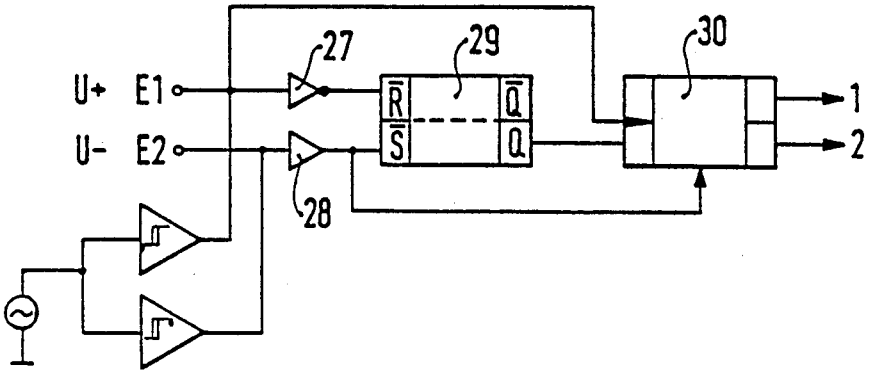

DEVICE FOR CONTROLLING INTERVAL COMBUSTION ENGINE

BACKGROUND OF THE INVENTION

The present invention deals with a device for controlling an internal combustion engine of a motor vehicle. More particularly, it relates to a device for controlling the internal combustion engine of a motor vehicle which has a sensor system with a transducer wheel having on its circumference a plurality of segments proportional to the number of cylinders of the engine, and a stationary pickup element which is affected by the segments of the transducer wheel and provided with a control circuit for ignition or the like of the motor vehicle In a devices for controlling an internal combustion engine of a motor vehicle, in particular for controlling its ignition and the like, it is known to use sensor systems for detecting the angular position of an shaft, in particular the crank shaft or the camshaft.

Such systems are embodied as segmental systems, for example, in which transducer wheels rotate with the shaft and are provided on their circumference with a number of segments, that is, elongated marked zones, that is proportional to the number of cylinders in the engine. For detecting the angular position of the crankshaft, the number of segments is one-half the number of cylinders. For detecting the angular position of the camshaft, the number of segments equals the number of cylinders, because as is well known, the crankshaft rotates at twice the speed of the camshaft. Each segment is correlated with one cylinder (or in the case of detection of the crankshaft, with two cylinders) of the engine, and each ignition event is controlled as a function of the travel past it of the associated segment. The leading edge of the segment is recognized in a stationary pickup element, and the control events for the engine are triggered by suitable timing control over the entire length of the segment. Segmental systems having segments of equal size have the disadvantage, by comparison, that it is impossible to correlate the segments properly for a distributorless or dual-circuit (in an eight-cylinder engine, for example) high-voltage distribution.

Segmental systems are also known in which individual segments are divided into a number of teeth and tooth gaps, and the signals generated in the pickup element by the teeth or tooth gaps are supplied to a control circuit. The angular position of the shaft is ascertained by counting the teeth or tooth gaps traveling past. This method is complicated and requires an extra counting device.

Also, if only a single tooth gap is formed in one segment, then there is the danger that the aditional trailing edge will trigger an additional ignition.

In all the devices discussed above, recognition of an accurate correlation of the marking requires at least one rotation upon startup of the engine.

SUMMARY OF THE INVENTION

Accordingly, it is an object of the present invention to provide a device for controlling an internal combustion engine, which avoids the disadvantages of the prior art.

In keeping with these objects and with others which will become apparent hereinafter, the invention resides in a device for controlling an internal combustion engine of a motor vehicle at least one of the segments has a perforation, the width of which increases in a circumferential direction and which supplies a signal serving as a marking for a control circuit provided in the pickup element.

When the device for controlling an internal combustion engine is designed in accordance with the present invention, it has the advantage over the prior art that correlation of the ignition pulses for a distributorless or dual-circuit high-voltage distribution is attainable with a single transducer, while retaining the two electrical marks at the beginning and end of the segment. Because of the resultant electrical signals (marks), the cylinder groups in a distributorless high-voltage distribution can be unequivocally correlated. No changes in the profile of the segments are necessary, so that especially at high engine output torque, stress cracks cannot form.

The novel features of the present invention are set forth in particular in the appended claims. The invention itself, however, both as to its construction and its manner of operation will be best understood from the following description of preferred embodiments which is accompanied by the following drawings.

BRIEF DESCRIPTION OF THE DRAWINGS

FIGS. 4*a*–4*c* a pulse diagram during operation of the inventive device for controlling an internal combustion engine; and FIG. 5 is a diagram showing an electronic circuit of the device for controlling an internal combustion engine in accordance with the present invention.

DESCRIPTION OF THE PREFERRED EMBODIMENTS

Figure 1:
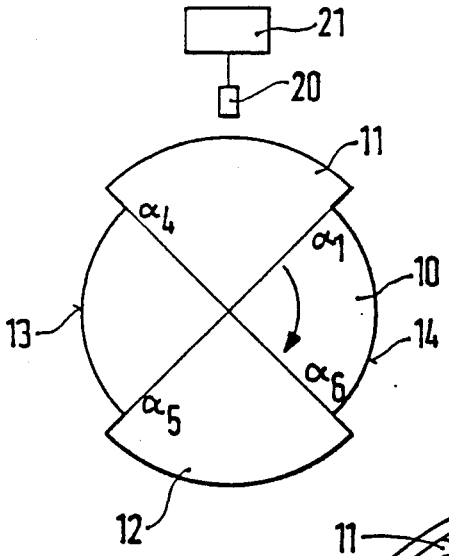
FIG. 1 is a view schematically showing a device for controlling an internal combustion engine including a pickup element with a control circuit, and a transducer wheel.

In FIG. 1, 10 represents a transducer wheel, which rotates with the crankshaft or camshaft of an internal combustion engine. The transducer wheel 10 has segments 11, 12 on its circumference, as well as gaps 13, 14 located between them. If there are two segments and two gaps, as in FIG. 1, and if the transducer wheel is secured to the crankshaft of the engine, then the arrangement is suitable for devices for controlling four-cylinder engines. The segments 11, 12 are embodied of equal length and are located diametrically opposite one another.

Figure 2:
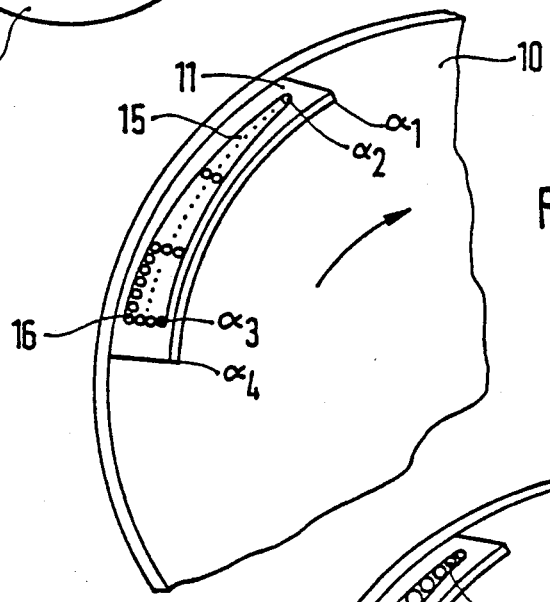
FIG. 2 is a perspective view of the transducer wheel in accordance with one embodiment of the invention.
Figure 3:
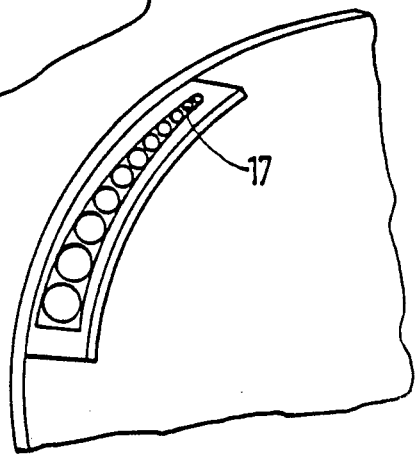
FIG. 3 is a perspective view of the transducer wheel in accordance with another embodiment of the present invention.

In FIG. 2, the segment 11 is shown in further detail. On its surface, it has a crescent-shaped perforation 15, which increases in width as the angle of the crankshaft increases. THe perforation 15 may comprise holes 16 of equal diameter, which are distributed uniformly over the perforation 15. As shown in FIG. 3, the perforation 15 can also comprise a series of holes 17 the diameter of which increases in accordance with the increasing width of the perforation 15. The perforation 15 can also be embodied as an equilateral triangle.

In the vicinity of the circumference of the transducer wheel 10, there is a stationary pickup element 20, which is turn is operatively connected with a control circuit 21. The kind of interaction of the transducer wheel 10 and the pickup element 20 may be quite various. If magnetic interactions are used, the transducer wheel 10 may be stamped out of ferromagnetic sheet metal, and an inductive transducer that already has a magnetic flux in the state of repose is used as the pickup element 20. In the exemplary embodiment of FIG. 2, the diameter of the pole core of the pickup element 20 should be larger than the diameter of the holes 16.

If the transducer wheel 10 rotates clockwise, as shown in FIG. 1, then—in segment 11, for example—the leading edge of the segment 11 is detected first by the pickup element 20. The ignition event can then be triggered, for example at the end of the segment 11, at an angular position corresponding to the trailing edges of the segment 11.

To illustrate the mode of operation of the device shown in FIG. 1, FIG. 4 shows the course over time of the signals generated by the segments 11, 12 or by the gaps 13, 14 and by the perforation 15. In FIG. 4*a*, the rotational movement of the crankshaft ($\Delta KW$) is plotted on the rotation of the transducer wheel 10 as a function of the rotational angle ($\alpha$) of the transducer wheel. In FIG. 4*b*, the magnetic flux ($\Delta\Phi$) generated in the pickup element 20 is shown as a function of the rotational angle ($\alpha$) of the transducer wheel 10. If the transducer wheel 10 moves clockwise, a change in the magnetic flux in the pickup element 20 is generated at the leading edge of the segment 11, that is, at the angular position $\alpha_1$. The magnetic flux continues at the same level while the segment 11 moves past the pickup element 20, until the beginning of the perforation 15; hence no voltage is induced. Once the pickup element 20 reaches the perforation 15 of the segment 11, that is, once the transducer wheel 10 is in the angular position $\alpha_2$, the magnetic flux drops, because of the increasing width of the perforation 15. Once the pickup element 20 reaches the angular position $\alpha_3$, the perforation 15 is at an end, and the magnetic flux rises once again to the same level as between the angular positions $\alpha_1$ and $\alpha_2$. If the pickup element 20 is in the angular position $\alpha_4$, at the trailing edge of the segment 11, the magnetic flux drops completely. Both an additional variation in the magnetic flux and, if the angular positions $\alpha_3$ and $\alpha_4$ are located close to one another, the apparent variation in the magnetic flux are increased as a result of the perforation 15. During the passage of the gap 13 past the pickup element 20 that now takes place, no substantial magnetic flux is generated. As with the segment 11, a magnetic flux variation is now generated by the segment 12 as well, at both its trailing edge and its leading edge, that is, at the angular positions $\alpha_5$ and $\alpha_6$.

FIG. 4*c* now shows the pulses generated in the pickup element. A positive pulse is generated at the trailing edge of each of the segments 11, 12, that is, at the angular positions $\alpha_1$ and $\alpha_5$. Once the pickup element 20 reaches the trailing edge of the segments 11, 12, or in other words if the transducer wheel 10 is located in the angular position $\alpha_4$ or $\alpha_6$, then a negative pulse is brought about. Because of the perforation 15 in the segment 11 and the resultant varying magnetic flux, a slight, approximately equally high, pulse level is present in this region, that is, between the angular positions $\alpha_2$ and $\alpha_3$. At the end of the perforation 15, that is, at the angular position $\alpha_3$, a positive pulse is again produced. This additional pulse, brought about by the end of the perforation 15, can now be used as a marking. At the same time, by the transition from a positive to a negative pulse, the trailing edge of the segment 11 becomes clearly recognizable and can be distinguished from other pulses.

The voltages generated in the pickup element 20 at the edges of the segments 11 and 12 and of the perforation 15 are supplied, via two Schmitt triggers having different switching thresholds, to the two input terminals E1 and E2 of the evaluation circuit the basic layout of which is shown in FIG. 5. An inverter 27 is connected to the input terminal E1, to which the voltage $U_+$ is applied. Contrarily, a non-inverting driver stage 28 is connected to the input terminal E2, to which the voltage $U_-$ is applied. The output of the inverter 27 is connected to the inverting reset input of a bistable multivibrator 29, to the inverting set input of which the output of the driver stage 28 is connected. From the Q output of the bistable multivibrator 29, a line leads to the clear-enable input of a counter 30. The inverting clear input of the counter 30 is connected to the output of the driver stage 28. The voltage $U_+$ picked up before the inverter 27 is also applied to the counting input of the counter 30. Lines lead from the two outputs of the counter 30 to the two cylinder groups of a four-cylinder engine. This circuit serves to obtain a synchronizing pulse, so that when the engine is started an accurate correlation of the position of the transducer wheel to the rotation of the shaft at that time is already possible. Naturally, this evaluation principle is applicable to all engines having an even number of cylinders. In asymmetrical engines, care must be taken so that the asymmetry occurs within one crankshaft rotation.

It will be understood that each of the elements described above, or two or more together, may also find a useful application in other types of constructions differing from the types described above.

While the invention has been illustrated and described as embodied in a device for controlling an internal combustion engine of a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for controlling an internal combustion engine of a motor vehicle, comprising a stationary pickup element provided with a control circuit for ignition or the like of a motor vehicle; and a transducer wheel arranged to rotate with a shaft of the engine of the motor vehicle and operatively connected with said stationary pickup element, said transducer wheel having a circumference and being provided on said circumference with a number of segments that is proportional to a number of cylinders of the engine, said segments affecting said pickup element and extending substantially in a circumferential direction, at least one of said segments having a perforation with a width which is measured in a direction transverse to a direction of elongation of said segment and which increases in the direction of elongation of said segment to supply a signal serving as a marking for said control circuit.

2. A device for controlling an internal combustion engine as defined in claim 1, wherein said perforation is formed so that said width increases with an increasing angle of the shaft on which said transducer wheel is arranged.

3. A device for controlling an internal combustion engine as defined in claim 1, wherein each of said segments of said transducer wheel has a steeply dropping leading edge and a trailing edge.

4. A device for controlling an internal combustion engine as defined in claim 1, wherein said perforation of said at least one segment comprises a plurality of holes distributed so that said width of said perforation increases in said direction of elongation of said at least one segment.

5. A device for controlling an internal combustion engine as defined in claim 4, wherein said holes of said perforation of said at least one segment have equal diameters and are arranged so that a number of holes in said perforation as considered in said transverse direction increases in said direction of elongation of said at least one segment.

6. A device for controlling an internal combustion engine as defined in claim 4, wherein said holes of said perforation of said at least one segment have different diameters and are arranged so that the diameters of the holes increase in direction of elongation of said at least one segment and correspond to the width of said perforation in said transverse direction.

7. A device for controlling an internal combustion engine as defined in claim 4, wherein said holes have a predetermined diameter, said pickup element being an inductive transducer with a pole core which is larger than the diameter of said holes.

8. A device for controlling an internal combustion engine as defined in claim 1, wherein said perforation of said at least one segment is formed as a crescent-shaped perforation.

9. A device for controlling an internal combustion engine having an ignition with distributorless high-voltage distribution, as defined in claim 1, wherein said transducer wheel is a part of the ignition having distributorless high-voltage distribution.

10. A device for controlling an internal combustion engine with an ignition having dual-circuit high-voltage distribution, as defined in claim 1, wherein said transducer wheel is a part of the ignition having dual-circuit high-voltage distribution.

* * * * *